US008713835B1

(12) United States Patent
Calvert

(10) Patent No.: US 8,713,835 B1
(45) Date of Patent: May 6, 2014

(54) CAPACITY REDUCIBLE MAGAZINE

(71) Applicant: CRMAG Associates, Trustee for CRMAG CRT Trust, Manassas, VA (US)

(72) Inventor: S. Mill Calvert, Manassas, VA (US)

(73) Assignee: CRMAG Associates, Manassas, VA (US), Trustee for CRMAG CRT Trust ( * ) Notice: Subject to any disclaimer, the term of this patent is extended or adjusted under 35 U.S.C. 154(b) by 0 days.

(21) Appl. No.: 13/919,553

(22) Filed: Jun. 17, 2013

Related U.S. Application Data

(63) Continuation-in-part of application No. 13/918,040, filed on Jun. 14, 2013, now Pat. No. 8,607,489.

(51) Int. Cl.
*F41A 9/71* (2006.01)

(52) U.S. Cl.
USPC ..... 42/49.02; 42/49.01

(58) Field of Classification Search
USPC ..... 42/49.01, 49.02, 50, 11, 17, 21, 24, 33, 42/35, 37, 39, 1.02; 89/33.01, 195, 197
See application file for complete search history.

(56) References Cited

U.S. PATENT DOCUMENTS

| | | | | | |
|---|---|---|---|---|---|
| 376,901 | A | * | 1/1888 | Morris | 42/50 |
| 1,028,032 | A | * | 5/1912 | Krag | 89/140 |
| 1,044,983 | A | * | 11/1912 | Brown | 42/50 |
| 1,245,499 | A | * | 11/1917 | Orme | 42/7 |
| 1,252,094 | A | * | 1/1918 | De Lempdes | 42/106 |
| 1,299,303 | A | * | 4/1919 | Cowles | 42/50 |
| 1,351,370 | A | * | 8/1920 | Chase | 42/7 |
| 1,913,827 | A | * | 6/1933 | Bradbury | 42/18 |
| 2,396,816 | A | * | 3/1946 | Boudreau | 42/50 |
| 2,620,582 | A | * | 12/1952 | Stukas | 42/50 |
| 2,828,568 | A | * | 4/1958 | Sakewitz | 42/50 |
| 3,777,383 | A | | 12/1973 | Haines et al. | |
| 3,964,199 | A | * | 6/1976 | Musgrave | 42/50 |
| 4,329,802 | A | * | 5/1982 | Coonan | 42/50 |
| 4,472,900 | A | * | 9/1984 | Howard | 42/50 |
| 4,488,371 | A | * | 12/1984 | Boyles | 42/90 |
| 4,509,283 | A | * | 4/1985 | Chesnut | 42/50 |
| 4,516,346 | A | * | 5/1985 | Farrar et al. | 42/50 |
| 5,113,605 | A | * | 5/1992 | Kim | 42/50 |
| 5,206,444 | A | | 4/1993 | Oliver | |
| 5,309,660 | A | * | 5/1994 | Blackamore | 42/50 |
| 5,507,110 | A | | 4/1996 | Chesnut et al. | |
| 5,584,136 | A | * | 12/1996 | Boland et al. | 42/7 |
| 5,826,360 | A | | 10/1998 | Herold et al. | |
| 5,845,426 | A | | 12/1998 | Valorose | |
| 8,225,541 | B2 | | 7/2012 | Bigley et al. | |
| 8,316,567 | B2 | * | 11/2012 | Douglas | 42/50 |
| 2012/0246988 | A1 | | 10/2012 | Ladner | |

* cited by examiner

*Primary Examiner* — Jonathan C Weber
(74) *Attorney, Agent, or Firm* — Louis Ventre, Jr.

(57) ABSTRACT

A magazine for a firearm is adjustable for cartridge capacity using a thumb slide to select the quantity of cartridges to be held by the magazine. The thumb slide is operable in a vertical slot and below the carriage pushing up on the bullets. The thumb slide protrudes into the internal chamber through the vertical slot so as to form an obstruction preventing downward movement of the carriage beyond the obstruction. Alternatively, the thumb slide raises a platform on which a segmented spring rests. When the platform is raised, it reduces available storage in the magazine. If a capacity selection requires a smaller spring, then spring segments are removed. A set screw locks the thumb slide in place. An indicator bar shows through holes in the magazine indicating the number of cartridges remaining in the magazine. A bolt and nut is introduced to permanently prevent further adjustment.

2 Claims, 2 Drawing Sheets

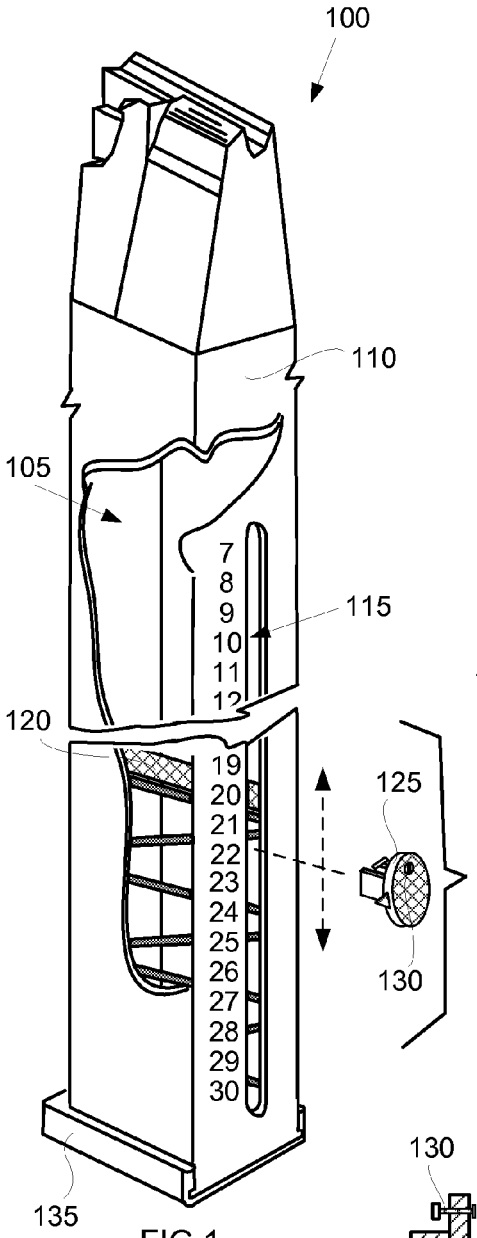
FIG.1
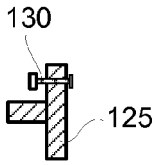
FIG.2
FIG.3
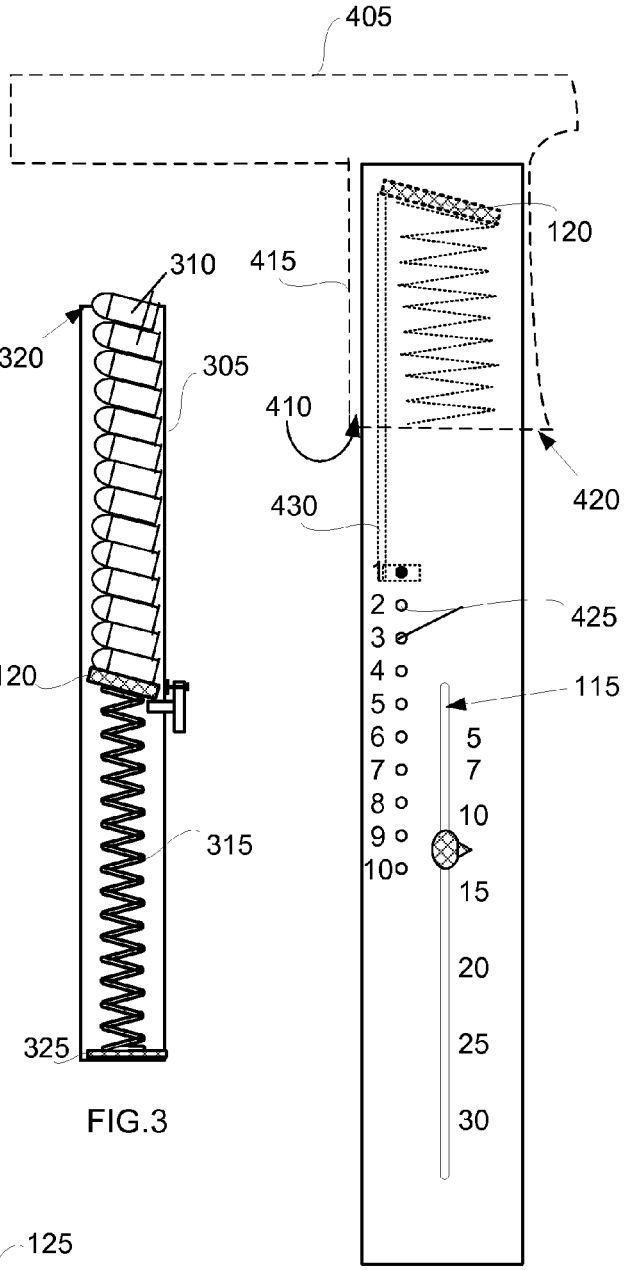
FIG.4

CAPACITY REDUCIBLE MAGAZINE

CROSS-REFERENCE TO RELATED APPLICATIONS

This application is a continuation in part application of U.S. patent application Ser. No. 13/918,040, filed 14 Jun. 2013, which is hereby incorporated by reference herein.

TECHNICAL FIELD

In the field of breech-loading firearms, a magazine is structured with a mechanism for adjusting its capacity for holding ammunition.

BACKGROUND ART

Magazines for firearms are used to assist in chambering cartridges into the breech of the firearm and are typically designed to hold a fixed quantity of cartridges. The capacity of a magazine is generally a function of the length and width of the magazine and the space consumed by the spring and follower used to move cartridges through the magazine housing.

Some of the states of the United States have enacted specific limits on cartridge capacity of magazines and these limits are not uniform among these states. Generally, the solution invoked to lower the capacity of a magazine involves physically reducing cartridge storage space within the magazine. Aftermarket solutions for reducing magazine capacity typically involve adding a plug to the magazine to prevent the magazine from holding more than the desired quantity of cartridges.

SUMMARY OF INVENTION

A magazine for a firearm is adjustable for cartridge capacity using a thumb slide to select the quantity of cartridges to be held by the magazine. The magazine includes an elongated housing having an internal chamber defined by a wall. The internal chamber holds the cartridges, a spring to move the cartridges and a carriage atop the spring to guide the cartridges. A thumb slide is operable up and down the housing within the vertical slot and below the carriage. The thumb slide protrudes into the internal chamber through the vertical slot so as to form an obstruction preventing the downward movement of the carriage beyond the obstruction. A set screw may be tightened to secure the thumb slide at the desired location and prevent the thumb slide from moving.

The magazine preferably has apertures vertically oriented through the magazine wall. These are holes located below the well of the gun that holds the magazine. For this embodiment an indicator bar is attached to the carriage so that when the carriage is within the well with at least one cartridge within the magazine, the indicator bar extends downward within the inner chamber to show through one of the apertures representing the number of cartridges remaining in the magazine.

In an alternate embodiment the thumb slide is attached to a platform below the spring and raising the thumb slide also raises the spring. For this embodiment, the spring comes in removable sections, so that if a capacity selection requires a smaller spring, then removable spring sections are removed once a removable bottom cover to the magazine is removed to gain access to the internal chamber.

In order to make the magazine more or less permanently selected at a capacity, a bolt secured by a nut is located through the wall to prevent downward movement of the platform beyond the bolt.

Technical Problem

Manufacturers and gun owners are facing an onslaught of disparate laws specifying the maximum cartridge capacity for a firearm. Depending on the state one lives in, the cartridge capacity of lawful magazines may be unspecified or it may be as low as seven cartridges, the latter limit recently enacted by the state of New York.

Magazines holding the cartridges come in a variety of sizes and sometimes a state can specify a maximum capacity that is lower than the standard magazine manufactured for the gun. Presently, there is no convenient way to manufacture a large capacity magazine, with the capability to relatively easily adjust the cartridge capacity of the magazine to a permanently adjusted cartridge capacity setting, or to a temporarily adjusted cartridge capacity setting.

Cartridge capacity selection along with an indicator of remaining ammunition is not a combination of capabilities presently available in cartridge magazines for guns.

Solution to Problem

The solution is a magazine that has a thumb slide to select the cartridge capacity. The thumb slide can lock in place with a set screw. If a law required that the magazine could not be sold because it could easily be adjusted to into a capacity exceeding the state limit, then the set screw would be covered with a coating so that it would not be further adjustable. Additionally, a nut and bolt running through the magazine would more permanently stop the bottom of the spring platform from moving past it and enlarging the cartridge capacity beyond the designated amount. The extra space at the bottom of such a magazine could be used to store extra ammo, or gun cleaning supplies.

Advantageous Effects of Invention

If the gun owner lives in a state where the maximum magazine capacity is seven bullets, he can immediately adjust a 10 or 15 round magazine to the maximum allowed capacity. The magazine gives gun owners the ability to easily comply with specific state laws regarding magazine capacity, no matter how frequently the law changes. Because the magazine is adjustable, a gun owner does not have to try to find a new magazine to buy, every time his state changes the magazine capacity law.

A police officer can instantly tell if a gun owner is in compliance with the capacity law by just looking at the scale on the magazine to see what capacity is selected.

If a gun owner lives in a state like New York that changed its law to restrict guns to a seven-round capacity, the gun owner may have no idea how many rounds are in his 10-round capacity magazine, and whether or not his gun is in compliance unless he arduously removes each bullet in the magazine one at a time and counts them.

Once the thumb slide is tightened with an Allen wrench, screw driver or other tool, no bullets beyond the selected capacity can be added to the magazine.

If state law does not permit the gun owner to be able to adjust the slide capacity himself, the magazine can be pre-set at the factory for the designated capacity and a coating can be placed over the set screw so that it can no longer be adjusted by the gun owner without obvious tampering signs.

If the magazine comes from the factory set for a state specific capacity so that it cannot be adjusted, it can also come with a nut and bolt through the magazine to act as a bottom stop for the spring. Then, the unused space in the bottom of the magazine can be used for storage space for a gun cleaning kit.

The bolt and nut offer the potential to limiting capacity expansion modifications because they add a permanency that may be considered fully compliant legally. While bolts and nuts can be configured to prevent removal without significant investment of time and effort, it would be beneficial to have at least the remote potential to drill out the bolt and nut to restore the magazine to its selectable capacity configuration should the owner move to a less restrictive state where these restrictions do not exist.

The magazine also has an indicator to show the number of bullets within the magazine. Knowledge of the precise number of rounds remaining in a weapon, or an indication that live ammunition is present in the weapon will be helpful to law enforcement because in the confusion of a shoot-out, the officer will know exactly how many bullets are left. Such indicator also offers an additional safeguard to preventing accidental shootings.

Cartridge capacity selection along with an indicator of remaining ammunition within a magazine provide law enforcement officers, military personnel, hunters, gun owners, and others with a mechanism for easily and accurately adjusting the cartridge capacity for their magazine, while at the same time also displaying the number of unfired rounds remaining in the magazine.

BRIEF DESCRIPTION OF DRAWINGS

The drawings illustrate preferred embodiments of the magazine according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

FIG. 1 is a perspective of a magazine with a cut out showing the carriage and spring and an exploded view of the thumb slide.

FIG. 2 is a side elevation view of the thumb slide.

FIG. 3 is a sectional view of an embodiment of a magazine showing the thumb slide preventing downward movement of the carriage.

FIG. 4 is a front elevation view of a magazine showing the thumb slide, capacity indicators and mechanism for revealing the bullets left in the magazine.

DESCRIPTION OF EMBODIMENTS

Figure 5:
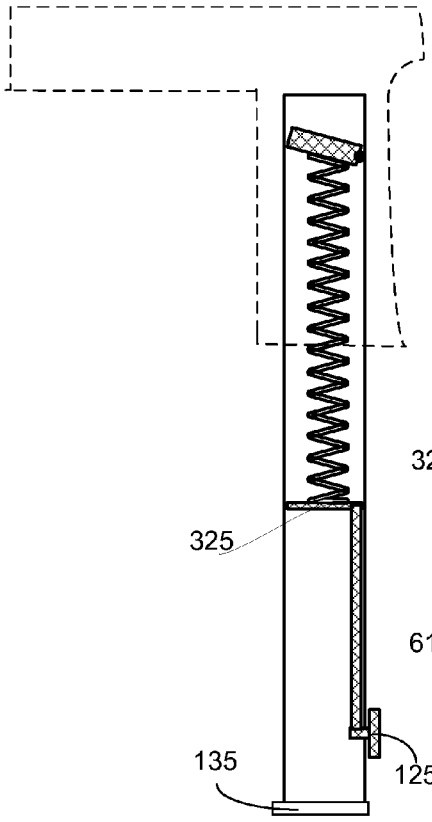
FIG. 5 is a sectional view of an alternative embodiment showing the thumb slide attached to a platform holding the spring.

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

FIG. 1 and FIG. 4 illustrate magazines for a firearm (405). The firearm (405) is shown only to put the magazine (100) in context. The magazine (100) in FIG. 1 is primarily referred to in the following discussion for convenience as an exemplary embodiment, but all of the magazines shown in the drawings conform to the disclosure herein. The magazine (100) has an elongated housing (305), which is essentially a cuboid that has either a narrowing exit end or a uniform cross-section along the entire length of the magazine. The magazine (100) may also have a uniform non-varying rectangular cross-section. Accordingly, the shape of the magazine (100) may vary, but such magazines have an internal chamber (105) defined by a wall (110). The internal chamber (105) is capable of holding a plurality of cartridges (310).

The elongated housing (305) of the magazine (100) defines a vertical slot (115) through the wall (110) defining the internal chamber (105). Essentially, the vertical slot (115) extends through one side of the magazine to provide access to the internal chamber (105).

The magazine (100) includes a spring (315) located within the internal chamber (105). This is typically a coiled compression spring, but may be other types of springs. The spring (315) exerts an upward and outward push on any of the plurality of cartridges (310) within the internal chamber (105).

The magazine (100) includes a carriage (120) atop the spring (315) that is disposed within the internal chamber (105) for urging the plurality of cartridges (310) towards an exit (320) to the magazine (100). The carriage (120) is usually molded to partially embrace a cartridge and correctly orient it for loading into the breech of the gun.

The magazine (100) includes a thumb slide (125), which is so named because it is preferably moved by action of a person's thumb to slide it to a cartridge capacity setting.

FIG. 1 shows exemplary markings for selecting a cartridge capacity between 7 and 30. Any number of markings indicating cartridge capacity settings may be used. For example, the capacity indicator numbers may start at 5 and end at 20, or may progress in twos or in fives from the starting number, as long as the numbers are within the cartridge capacity of the magazine (100).

The thumb slide (125) is operable within the vertical slot (115) below the carriage (120), that is, below the carriage (120) in its normal vertical orientation with the gun at the top of the magazine. The thumb slide (125) extends through the vertical slot (115) and into the internal chamber (105) so as to form an obstruction preventing the downward movement of the carriage (120) beyond the obstruction. The obstruction may be a simple straight-in peg that engages only one side of the carriage (120), or it may be rectangular or partially rectangular such that it engages two sides of a typically rectangular cross-section of the carriage (120). The obstruction formed by the thumb slide (125) should, preferably, extend into the internal chamber so far as to engage the edge of the carriage (120) to prevent it from moving below the obstruction, but the obstruction should not enter into the coils of the spring (315).

The magazine (100) of claim 1 optionally includes a set screw (130) operable to mechanically prevent the thumb slide (125) from moving when the set screw (130) is tightened. The set screw (130) may be located anywhere where it can operably be used to lock the thumb slide (125) to its capacity setting. For example, the set screw (130) could be located to tighten against the slot, for example by turning the thumb slide (125) 90-degrees, or it might be located on an arm extending from the thumb slide (125) to engage a small hole in the magazine when it is screwed down adjacent to the vertical slot (115). The exact mechanism for preventing further adjustment of the thumb slide (125) can vary.

As shown in FIG. 4, a firearm (405), such as a semi-automatic hand gun, may have a well (410) within a grip (415) where the well (410) is configured to receive the magazine (100). The well (410) starts at a distal end (420) that permits the magazine to be inserted. Preferable embodiments of the magazine (100) extend below this distal end (420). For such embodiments, the wall (110) of the magazine (100) defines a plurality of apertures (425), also known as holes, vertically oriented on the wall (110) and located below the distal end (420) of the well (410).

The FIG. 4 embodiment is a magazine having an indicator bar (430) attached to the carriage (120) such that when the carriage (120) is furthest from the distal end (420) within the well (410) with at least one cartridge within the magazine (100), the indicator bar (430) extends downward within the inner chamber to a point below the distal end (420) of the well (410) and shows through one aperture in the plurality of apertures (425) to indicate the number of cartridges remaining in the magazine (100).

Figure 6:
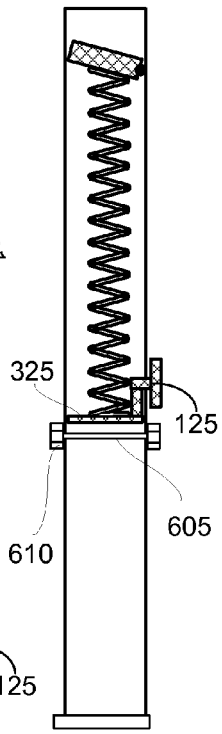
FIG. 6 is a sectional view of another alternative embodiment showing the nut and bolt added to make the capacity selection permanent.

FIG. 5 and FIG. 6 illustrate embodiments of a magazine with a removable bottom cover (135) that provides access to the internal chamber (105). These embodiments include a platform (325) capable of vertical movement within the internal chamber (105), which is connected to the thumb slide (125). The embodiment in FIG. 5 can be used to select a capacity below the standard magazine capacity of a firearm because the platform (325) can be moved to a relative position above the distal end (420) of the well (410).

Figure 7:
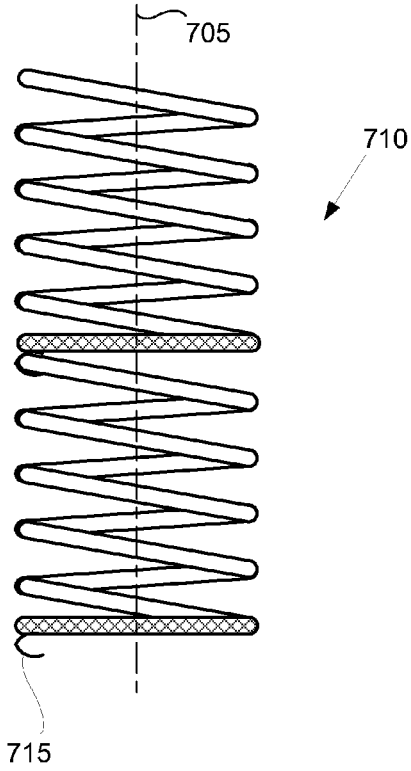
FIG. 7 is a side elevation view of two removable sections of the spring.

The FIG. 5 and FIG. 6 embodiments include a spring (315) made of a plurality of removable spring segments (710). The removable spring segments are illustrated in FIG. 7. The spring (315) is configured to rest on the platform (325), which is movable by the thumb slide (125). Removability is enabled by a c-shaped member (715) fixed to each removable spring segment in the plurality of removable spring segments (710). The c-shaped member (715) is configured to slidably receive another removable spring in the plurality of removable spring segments (710) so as to link the plurality of removable spring segments (710) together to approximately align on the same axis within the elongated housing (305). Thus, the c-shaped member (715) links all the removable spring segments in the plurality of removable spring segments (710) together in approximate alignment on an axis within the elongated housing. In using these embodiments, spring segments will typically be removed from the internal housing when a capacity setting is below the maximum setting or spring segments will be added when re-adjusting the thumb slide (125) to a larger capacity setting.

The magazine (100) may include a bolt (605) secured by a nut (610), the bolt (605) transiting through the wall (110) so that the nut (610) is secured to the bolt (605) outside the wall (110), and when so secured the bolt (605) prevents downward movement of the platform (325) beyond the bolt (605). The bolt (605) and nut (610) can be fashioned so that it may not be removed in order to fix the cartridge capacity of the magazine so that the cartridge capacity may not be enlarged by the end user.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A magazine for a firearm, the magazine comprising:

an elongated housing having an internal chamber defined by a wall, a closed end defining a bottom and a open end at the top defining an exit, the internal chamber capable of holding a plurality of cartridges, the elongated housing defining a vertical slot through the wall;

a spring located within the internal chamber;

a carriage atop the spring that is disposed within the internal chamber for urging the plurality of cartridges towards the exit;

a thumb slide operable within the vertical slot below the carriage, the thumb slide extending through the vertical slot and into the internal chamber so as to form an obstruction preventing downward movement of the carriage beyond the obstruction while enabling upward movement of the carriage and the plurality of cartridges within the internal chamber; and a set screw operable to prevent the thumb slide from moving when the set screw is tightened.

2. The magazine of claim 1, wherein the firearm comprises a well within a grip, the well configured to receive the magazine starting at a distal end of the well, wherein the wall of the magazine defines a plurality of apertures vertically oriented on said wall and located below the distal end of the well; the magazine further comprising an indicator bar attached to the carriage such that when the carriage is furthest from the distal end within the well with at least one cartridge within the magazine, said indicator bar extends downward within the internal chamber to a point below the distal end of the well and shows through one aperture in the plurality of apertures to indicate the number of cartridges remaining in the magazine.

* * * * *